US009172196B2

(12) United States Patent
Hemmi et al.

(10) Patent No.: US 9,172,196 B2
(45) Date of Patent: Oct. 27, 2015

(54) BRUSH HAVING A PLURALITY OF ELASTIC CONTACT PIECES ARRANGED IN PARALLEL

(71) Applicant: OMRON CORPORATION, Kyoto-shi (JP)

(72) Inventors: Yoshinobu Hemmi, Otsu (JP); Hideaki Ozaki, Takatsuki (JP); Hirotada Teranishi, Osaka (JP)

(73) Assignee: OMRON Corporation, Kyoto (JP)

( * ) Notice: Subject to any disclaimer, the term of this patent is extended or adjusted under 35 U.S.C. 154(b) by 131 days.

(21) Appl. No.: 13/949,775

(22) Filed: Jul. 24, 2013

(65) Prior Publication Data

US 2014/0038435 A1 Feb. 6, 2014

(30) Foreign Application Priority Data

Jul. 31, 2012 (JP) ..... 2012-170554

(51) Int. Cl.

| | |
|---|---|
| ***H01R 4/48*** | (2006.01) |
| ***H01R 35/02*** | (2006.01) |
| ***H01R 39/18*** | (2006.01) |
| ***H01R 39/24*** | (2006.01) |

(52) U.S. Cl.

CPC ..... *H01R 35/02* (2013.01); *H01R 39/18* (2013.01); *H01R 39/24* (2013.01)

(58) Field of Classification Search

CPC ..... H01R 39/18; H01R 39/24

USPC ..... 439/857, 862, 81, 22

See application file for complete search history.

(56) References Cited

U.S. PATENT DOCUMENTS

| | | | | |
|---|---|---|---|---|
| 5,296,774 | A * | 3/1994 | Nishiwaki | 310/248 |
| 6,007,344 | A * | 12/1999 | Corrunker et al. | 439/22 |
| 6,652,322 | B2 * | 11/2003 | Ito et al. | 439/637 |
| 6,672,875 | B1 * | 1/2004 | Mathieu et al. | 439/66 |
| 6,734,594 | B2 * | 5/2004 | Lee et al. | 310/220 |
| 7,168,990 | B2 * | 1/2007 | Suzuki et al. | 439/636 |

FOREIGN PATENT DOCUMENTS

| | | | |
|---|---|---|---|
| JP | 54-48009 | A | 4/1979 |
| JP | 55-120275 | U | 8/1980 |
| JP | 60-227378 | A | 11/1985 |
| JP | 64-081202 | A | 3/1989 |
| JP | 1-308146 | A | 12/1989 |
| JP | 2-99525 | U | 8/1990 |
| JP | 05-174934 | A | 7/1993 |
| JP | 05190241 | A | 7/1993 |
| JP | 09093877 | A | 4/1997 |
| JP | 2006-519467 | A | 8/2006 |

OTHER PUBLICATIONS

Korean Office Action issued Oct. 28, 2014 re: Korean Application No. 10-2013-0087802.

Japanese Office Action issued May 20, 2014 and English Translation Thereof, re: Japanese Application No. 2013-154846; pp. 12.

Korean Office Action (with English Translation) issued Apr. 29, 2014 re: Korean application No. 10-2013-0087802; 6 pp.

* cited by examiner

*Primary Examiner* — Tho D Ta

(74) *Attorney, Agent, or Firm* — Klarquist Sparkman, LLP

(57) ABSTRACT

An aspect of the present invention provides a brush in which positional accuracy of elastic contact pieces is enhanced while production cost is reduced by simplifying production, whereby the brush includes a support that is connected to a base and a conductive portion that is integral with the support, such that the conductive portion includes plural elastic contact pieces extending in parallel from a side edge of the support.

18 Claims, 12 Drawing Sheets

BRUSH HAVING A PLURALITY OF ELASTIC CONTACT PIECES ARRANGED IN PARALLEL

CROSS REFERENCE TO RELATED APPLICATION

This application claims benefit of priority to Japanese Patent Application No. 2012-170554, filed on Jul. 31, 2012 of which the full contents are herein incorporated by reference.

BACKGROUND OF THE INVENTION

The present invention relates to a brush. In particular, the present relates to a brush wherein plural elastic contact pieces are provided in parallel and are in contact with a conductive pattern placed in, for example, a rotating body in order to transmit an electric signal or an electric power between the rotating conductive pattern and the elastic contact pieces.

In accordance with a conventional configuration, a brush, as disclosed in Japanese Patent Publication No. 7-120563, consists of plural elastic contact pieces which are positioned and welded in parallel one by one to an edge portion of a support. Such a conventional configuration leads to a problem that it takes a lot of trouble with production of the brush, increases production cost, and a variation in positional accuracy of the elastic contact pieces is highly generated.

SUMMARY OF THE INVENTION

Accordingly, the invention provides a brush which overcomes the above-mentioned problems and limitations of conventional art. Further, the invention provides a brush in which the positional accuracy of the elastic contact pieces is enhanced as well as the production cost is reduced by simplifying the production.

In accordance with one aspect of the present invention, there is provided a brush comprising: a support connected to a base; and a conductive portion configured to be integral with the support and having a plurality of elastic contact pieces. Further, the conductive portion extends in parallel from a side edge of the support.

According to the present invention, the simplification of the configuration of the brush enables the reduction of the production cost and the enhancement of a degree of design freedom. The support and the conductive portion are integrally formed, so that a high strength and a low profile can be implemented compared with the brush in which different components are joined to each other.

According to another embodiment of the present invention, a sliding portion may be provided at a leading end of the elastic contact pieces, wherein the sliding portion is electrically connected to an external conductor.

Preferably, each ratio of a width to a thickness of the elastic contact pieces may be from 1:4 to 1:1.5.

According to still another embodiment of the present invention, the plurality of elastic contact pieces comprising the elastic contact piece having a width different from another elastic contact piece.

According to yet another embodiment of the present invention the plurality of an elastic contact pieces comprises the elastic contact piece having a thickness different from another elastic contact piece.

According to one of the preferred embodiments of the present invention, a length of each of the plurality of the elastic contact pieces gradually increases from one side edge of the support to the other side of the support.

According to another embodiment of the present invention, in the conductive portion of the brush, a line is drawn along a leading end of the conductive portion and the line is inclined with respect to the side edge of the support.

Preferably, in the conductive portion, the elastic contact pieces located on both side edges of the conductive portion may be widened.

According to still another embodiment of the present invention, the conductive portion may be curved along a thickness direction.

According to still another embodiment of the present invention, the conductive portion may be curved along a width direction.

According to yet another embodiment of the present invention the sliding portion may include a reverse U-shape bulge.

According to one of the preferred embodiment of the present invention, the sliding portion may include a reverse U-shape bulge and a protrusion that extends outward from the bulge on a straight line identical to the elastic contact piece.

According to another embodiment of the present invention, the sliding portion may include a bulge that protrudes downward from a lower surface of the elastic contact piece and a curved surface that is continuous with an upper surface of the elastic contact piece which may be provided in a corner portion on an upper side of the bulge.

Preferably, the support may be a parallelogram.

Preferably, the support may be made up of porous material.

According to yet another embodiment of the present invention, the brush may be produced by electroforming.

BRIEF DESCRIPTION OF THE DRAWINGS

The invention will become more readily appreciated and understood from the following detailed description of preferred embodiments of the invention when taken in conjunction with the accompanying drawings, in which.

DETAILED DESCRIPTION

Figure 1A:
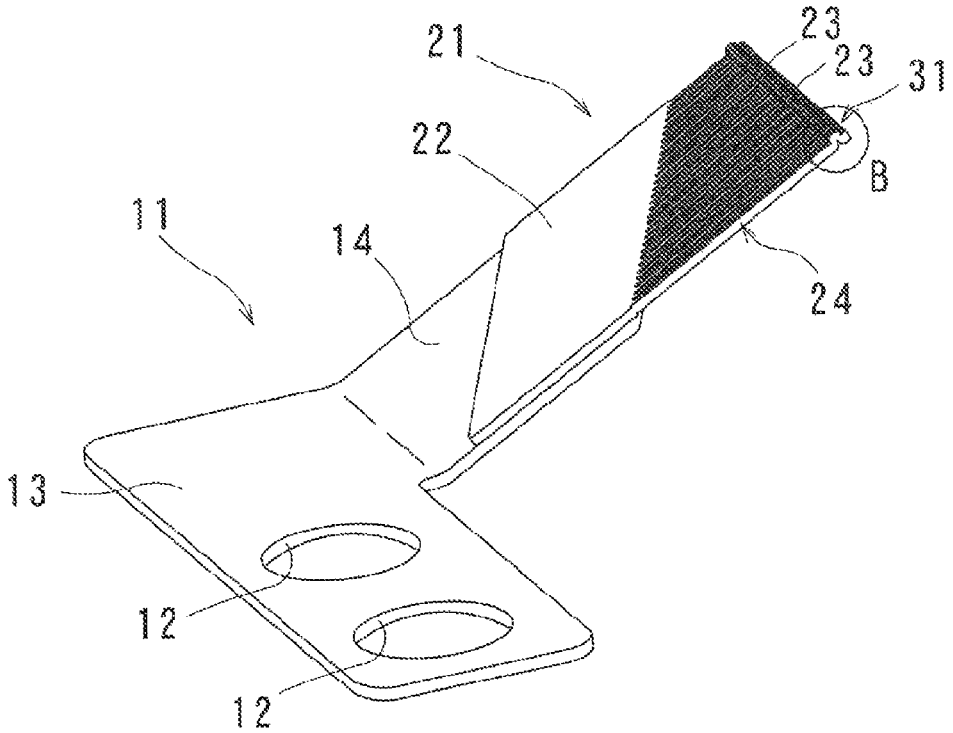
FIG. 1A is a perspective view of a state in which a brush according to a first embodiment of the present invention is fixed to a base.

The present invention is described hereinafter by various embodiments with reference to the accompanying drawings, wherein reference numerals used in the accompanying drawings correspond to the like elements throughout the description. Further, while discussing various embodiments, cross reference will made between the figures. In order to achieve full description and explanation, specific details have been mentioned to provide thorough and comprehensive understanding of various embodiments of the present invention. However, said embodiments may be utilized without such specific details and in various other ways broadly covered herein.

FIG. 1A illustrates a brush 21 according to a first embodiment of the present invention. The brush 21 includes a parallelogram support 22 and a conductive portion 24. The conductive portion 24 is constructed by plurality of elastic contact pieces 23 which are arranged in parallel on an edge portion of one side of the support 22. Such a simplified configuration of the brush 21 enables reduction of production cost and enhancement of a degree of design freedom. Because the support 22 is parallelogram, usage of material for composing the support 22 is reduced while a welding region is ensured. Further, the support and the conductive portion are integrally formed, so that a high strength and a low profile can be implemented compared with the brush in which different components are joined to each other. Also, the usage of a material for composing the support is reduced while a connecting region is ensured.

A rear surface of the support 22 is welded to one end portion of a substantial plane L-shape base 11. The base 11 includes a plate-like fixed portion 13 including a circular fixing through-hole 12 and a plate-like welded portion 14 extending obliquely upward from an edge of the fixed portion 13.

Figure 1B:
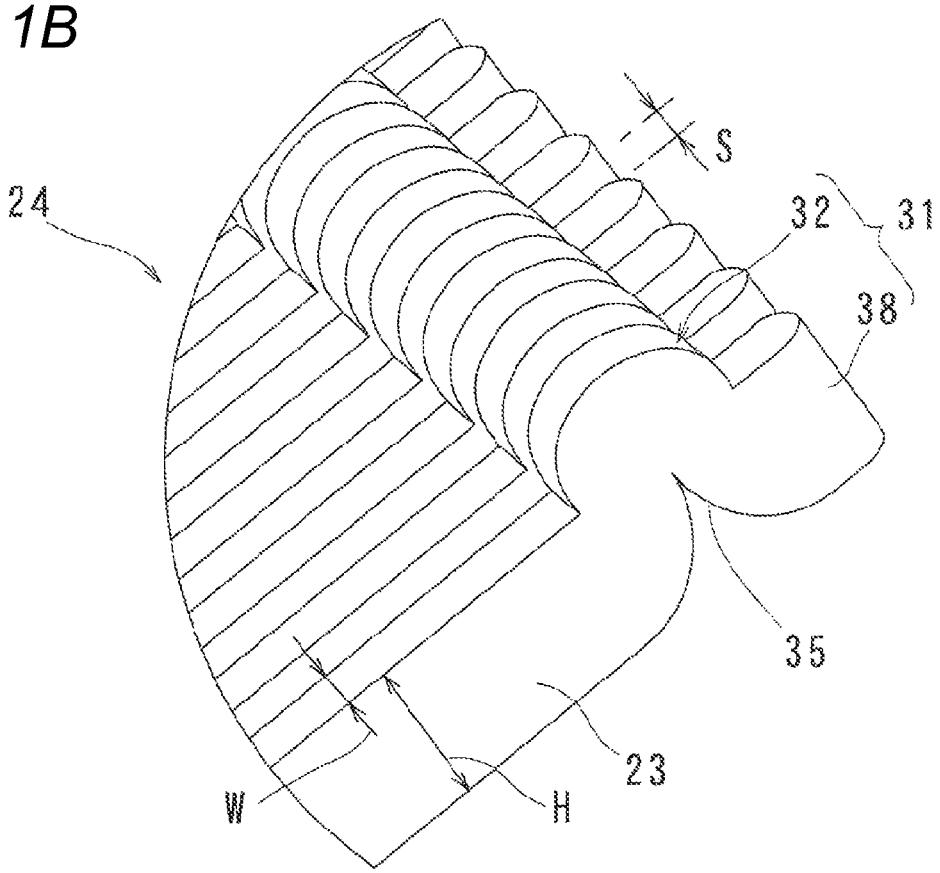
FIG. 1B is a partially enlarged perspective view of a B portion as shown in FIG. 1A.
Figure 2:
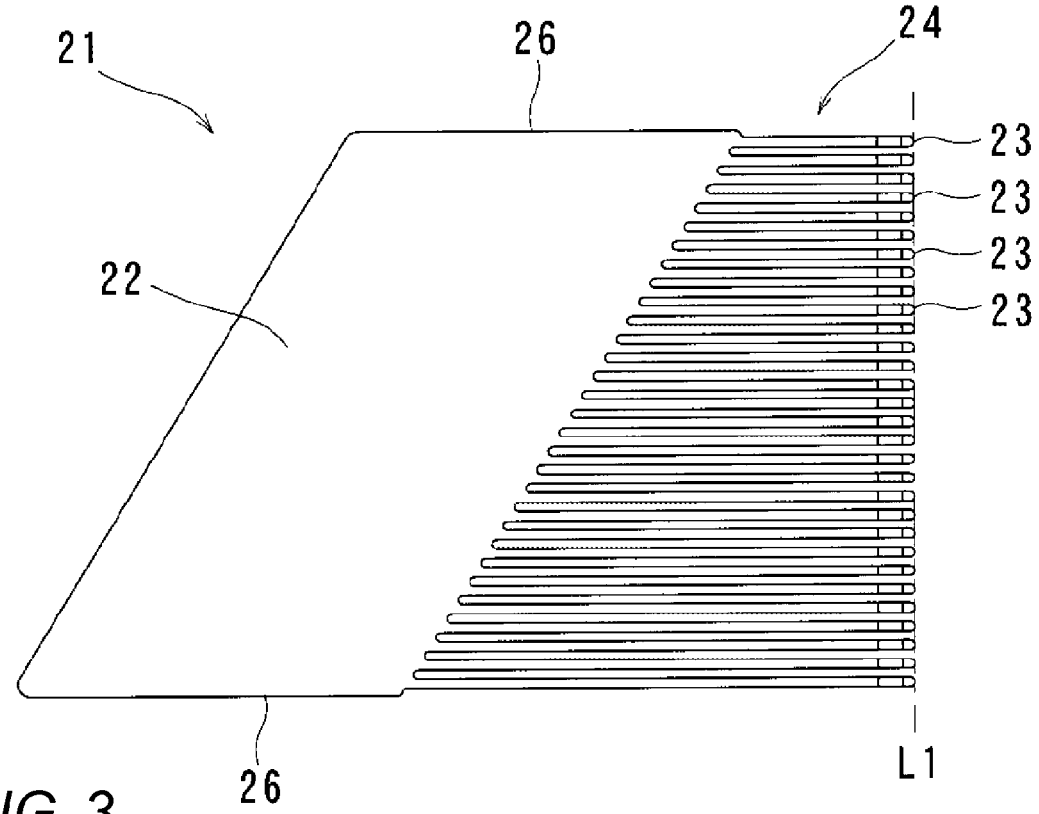
FIG. 2 is a plan view of the brush of the first embodiment of the present invention.

The elastic contact pieces 23 and the support 22 are integrally formed by electroforming. Therefore, the brush 21 in which positional accuracy of the elastic contact pieces 23 is enhanced while the production cost is reduced by simplifying the production is obtained. The plurality of elastic contact pieces 23 extend from one of the end portions of the support 22 in parallel with opposed two sides 26 of the support 22. In FIG. 2, length of each of plurality of the elastic contact pieces 23 gradually increases while place from the side edge of the support 22 to the other side of the support 22. On the other hand, a line L1 drawn along leading ends of the conductive portion 24 is perpendicular to the sides 26. As illustrated in FIG. 1B, the elastic contact piece 23 has a rectangular section, and preferably an aspect ratio of a width W to a thickness H thereof from 1:4 to 1:1.5. When the aspect ratio is greater than 1:4, the elastic contact pieces 23 are weakened against a force from a horizontal direction generating torsion, and a necessary pressing force is not obtained. When the aspect ratio is smaller than 1:1.5, an interval between the elastic contact pieces 23 adjacent to each other is increased. The thickness is decreased with decreasing interval, and the necessary pressing force is not obtained. More specifically, for example, in the case where the thickness H of the elastic contact pieces 23 is set to a range of 80 μm to 150 μm in order to satisfy the aspect ratio of 1:1.5, the width W is set to 100 μm or less. The elastic contact piece 23 is not limited to the rectangular section, but that the elastic contact piece 23 may have a semicircular section, for example. The width W and the thickness H are not limited to the mentioned specific numerical values, but of course, the width W and the thickness H may be arbitrarily set. Therefore, a contact pressure necessary to ensure the conduction can be obtained between sliding portions 31 and a printed board 16, while rigidity of the elastic contact pieces 23 are ensured. Each width W of the elastic contact pieces 23 may vary. Specifically, for example, the one elastic contact piece 23 may have a trapezoidal shape in planar view. It may be configured that among the elastic contact pieces 23 adjacent to each other, one of the elastic contact pieces 23 may have the width W less than that of the other elastic contact piece 23. Similarly, each thickness H of the elastic contact pieces 23 may vary.

Therefore, even if torsion is generated about an axis in a length direction of the brush, the contact force between each elastic contact piece and the printed board can homogeneously be maintained. That is, a difference in the contact forces applied to each elastic contact piece is eliminated by homogenizing a spring force of the elastic contact piece on one side and a spring force of the elastic contact piece on the other side, so as to ensure contact reliability and durability. Further, rigidity of the elastic contact pieces can be enhanced to obtain the desired contact pressure between the sliding portions and the printed board.

The sliding portion 31 that is in contact with, for example a printed board 16 (see FIG. 4B) is formed in a leading end portion of each elastic contact piece 23. Therefore, an inter-support-point distance between the support 22 and the sliding portions 31 is arbitrarily set by changing a length of the elastic contact pieces 23, and the desired contact pressure can be obtained between the sliding portions 31 and the printed board 16. As illustrated in FIG. 1B, the sliding portion 31 includes a reverse U-shape bulge 32 and a protrusion 38 that extends outward from the bulge 32 on a straight line identical to the elastic contact piece 23. An upper portion of the bulge 32 protrudes upward from an upper surface of the elastic contact piece 23, and a section of the bulge 32 is formed into a semicircular shape. A reverse V-shape groove 35 is formed upward in the lower portion of the bulge 32.

Figure 3:
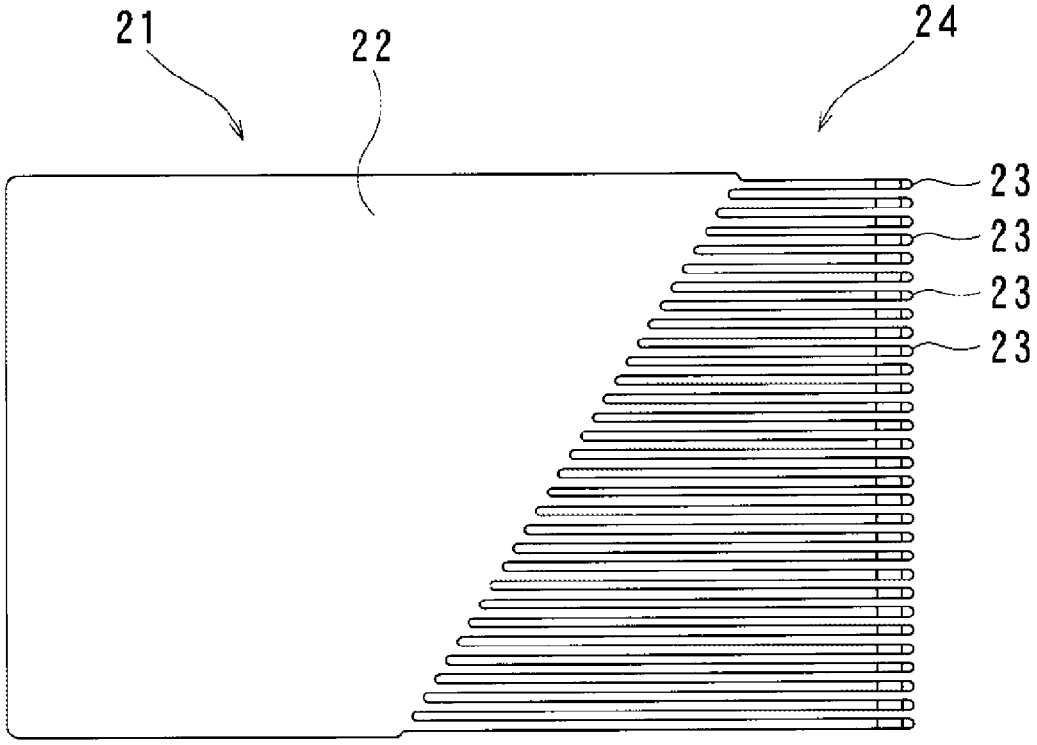
FIG. 3 is a plan view of a modification of the brush as shown in FIG. 2.

In the present embodiment, the support 22 is formed into the parallelogram shape, but is not limited thereto. Alternatively, for example, a trapezoidal support 22 may be used as illustrated in FIG. 3.

Figure 4A:
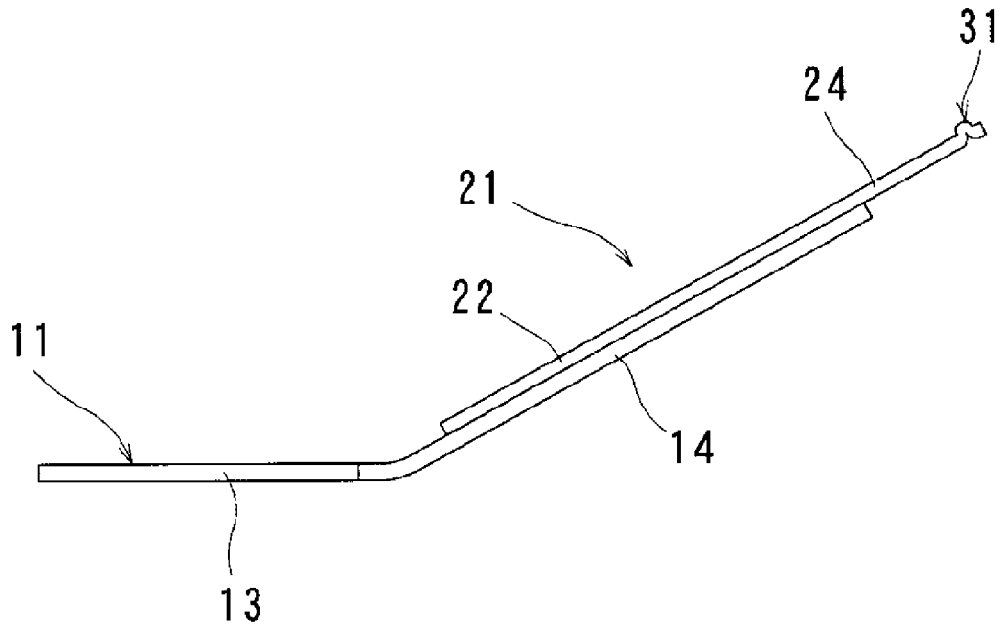
FIG. 4A is a side view of the base and the brush in FIG. 1 before actuation.
Figure 4B:
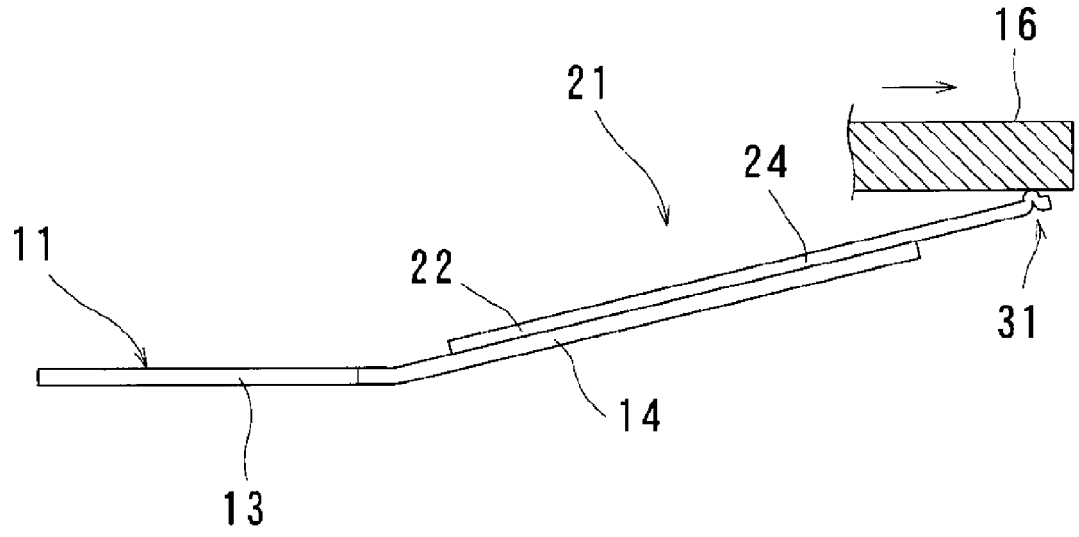
FIG. 4B is a side view of an operating state of FIG. 4A.

As illustrated in FIG. 4A, the brush 21 is welded to the base 11 and inclined with respect to the fixed portion 13. As illustrated in FIG. 4B, when the printed board 16 comes into contact with the sliding portions 31, the brush 21 is biased in an arrow direction together with the welded portion 14 of the base 11 and therefore the brush 21 falls. At this point, the sliding portions 31 are always in contact with the printed board 16 at a predetermined contact pressure by an elastic force of the base 11.

Figure 5A:
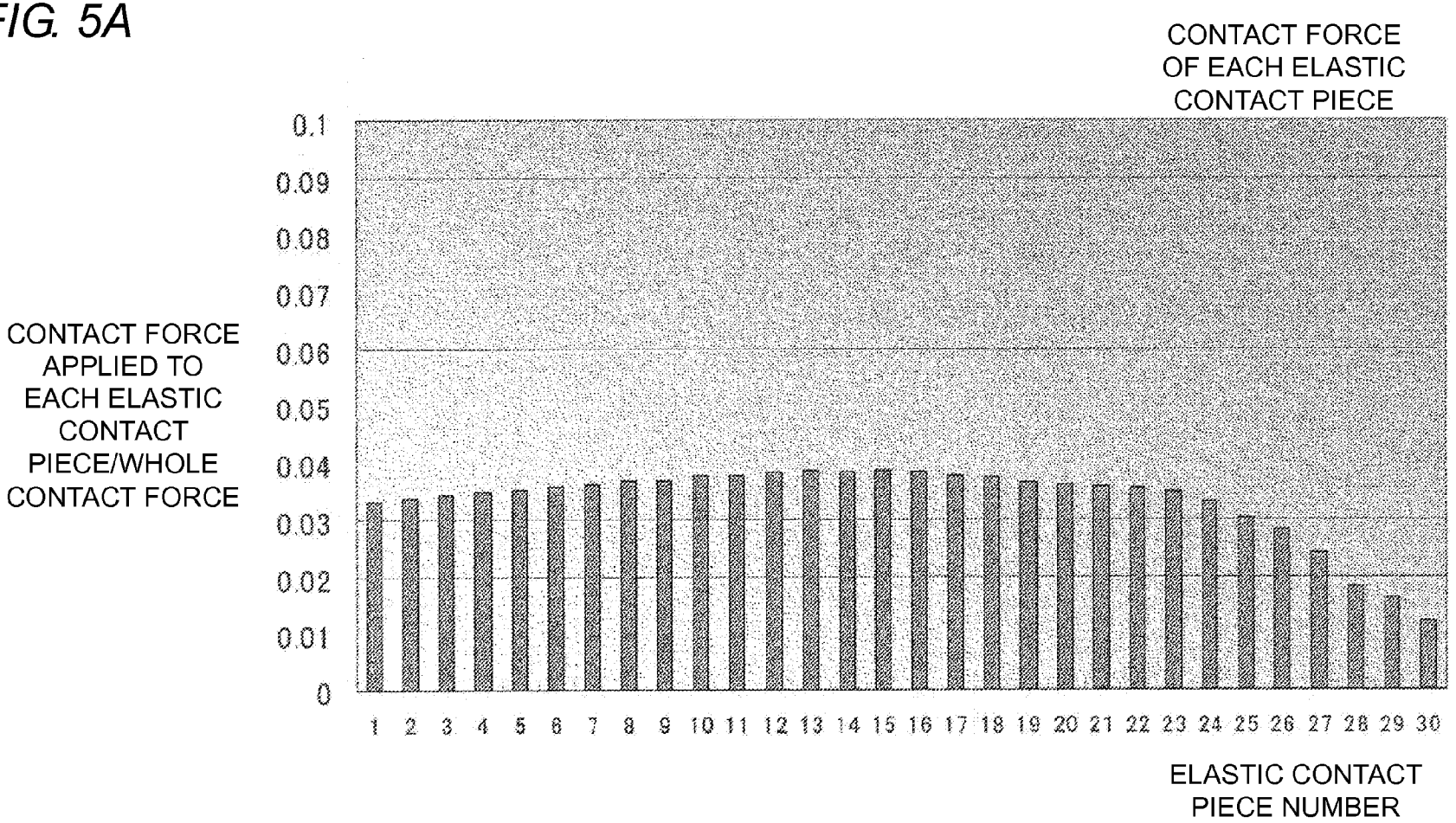
FIG. 5A is a graph illustrating a result of an example in which a ratio of a contact force applied to each elastic contact piece to a contact force with a printed board, which is applied to a whole conductive portion.
Figure 5B:
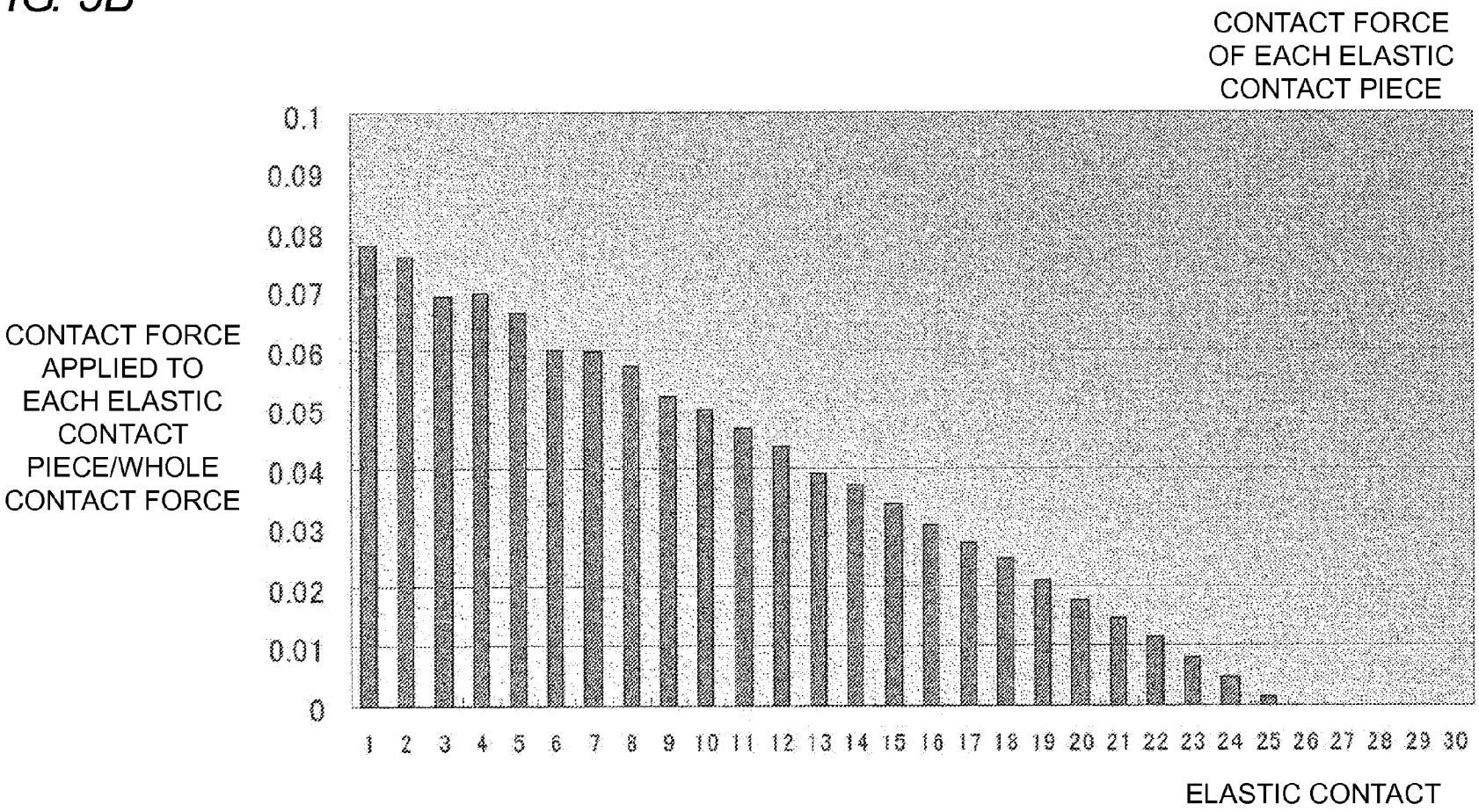
FIG. 5B is a graph illustrating a result of a comparative example in which a ratio of a contact force applied to each elastic contact piece to a contact force with the printed board, which is applied to the whole conductive portion wherein the elastic contact pieces having the same length.

Particularly, in the brush 21 of the present embodiment, each length of the elastic contact pieces 23 is gradually increased from the elastic contact piece 23 on one side toward the elastic contact piece 23 on the other side. For this reason, when the printed board 16 presses and displaces the sliding portions 31, the contact force between each elastic contact piece 23 and the printed board 16 can homogeneously be maintained even if a clockwise torsion moment acts on the brush 21 about a lengthwise-direction axis. That is, a difference in the contact forces generated in each elastic contact piece 23 is eliminated by homogenizing a spring force of the elastic contact piece 23 on one side and a spring force of the elastic contact piece 23 on the other side, so as to ensure contact reliability and durability. FIG. 5A illustrates a result of an example in which a ratio of the contact force applied to each elastic contact piece 23 to the contact force with the printed board 16, which is applied to the whole conductive portion 24. FIG. 5B illustrates a result of a comparative example in which a ratio of the contact force applied to each elastic contact piece to the contact force with the printed board, which is applied to the whole conductive portion including the elastic contact pieces having the same length. Therefore, it is confirmed that the contact forces applied to each elastic contact piece vary in the comparative example, whereas in the conductive portion 24 of the present embodiment, the contact force is homogeneously applied to each elastic contact piece 23.

Figure 6A:
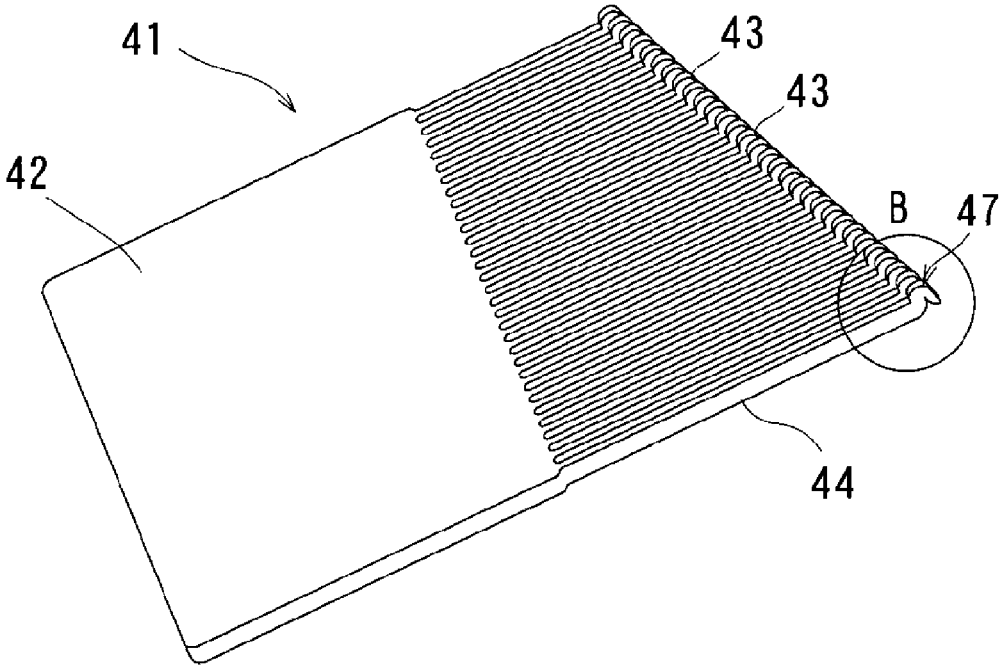
FIG. 6A is a perspective view of a brush according to a second embodiment of the present invention.
Figure 7:
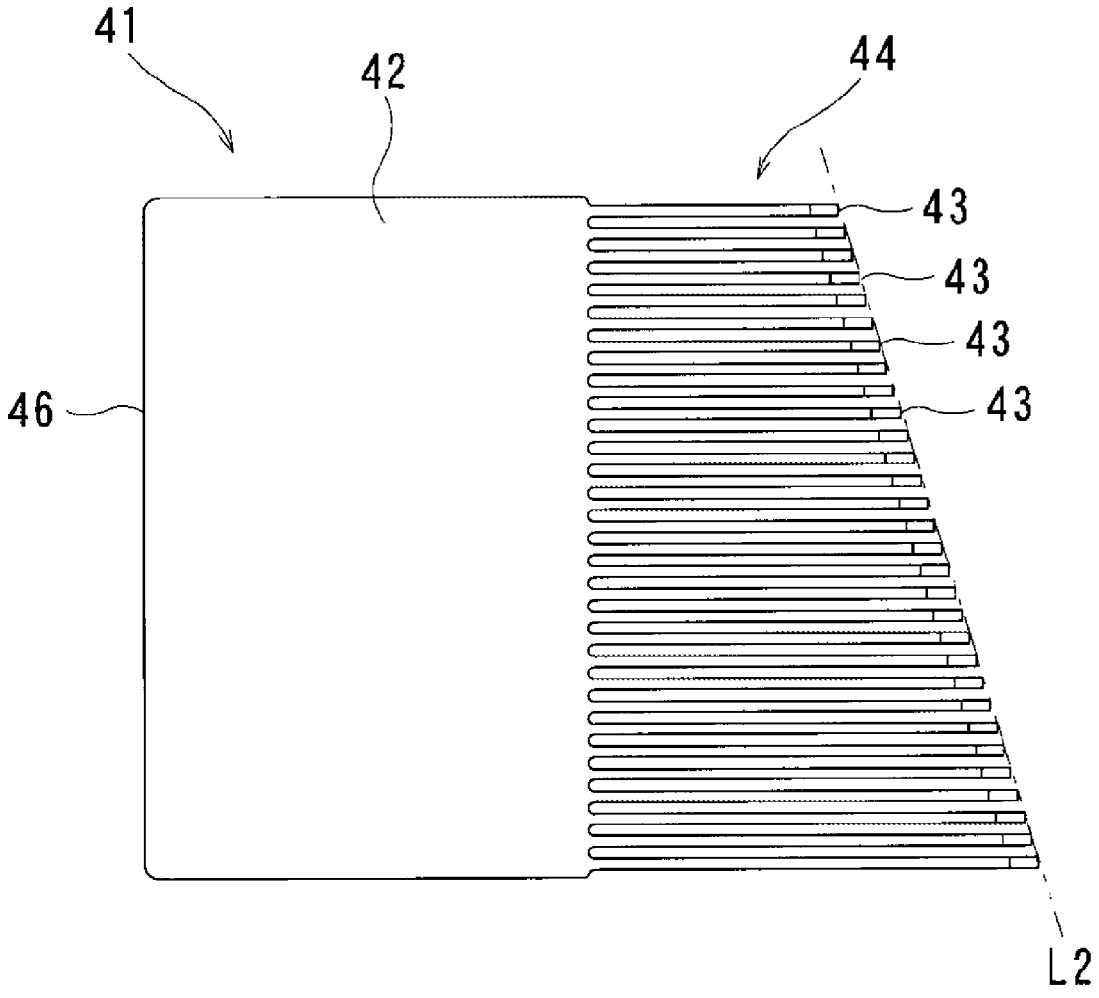
FIG. 7 is a plan view of the brush as shown in FIGS. 6A and 6B.

As illustrated in FIG. 6A, a brush 41 according to a second embodiment of the present invention includes a rectangular support 42 (see FIG. 7) and a conductive portion 44 including the plurality of elastic contact pieces 43.

Figure 6B:
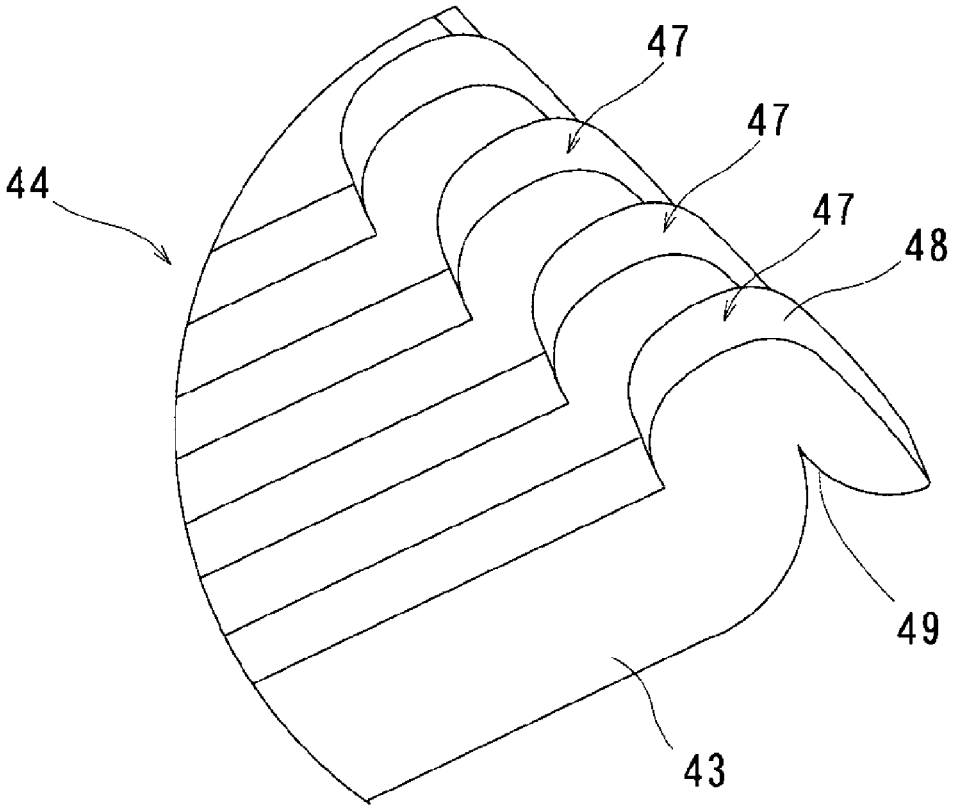
FIG. 6B is a partially enlarged perspective view of a B portion as shown in FIG. 6A.

A line L2 drawn along the leading ends of the plurality of elastic contact pieces 43 is inclined with respect to a long side 46 of the support 42. As illustrated in FIG. 6B, a sliding portion 47 is formed in the leading end portion of each elastic contact piece 43. The sliding portion 47 includes only a reverse U-shape bulge 48 each of which is continuous with the elastic contact piece 43. The upper portion of the bulge 48 protrudes upward from the upper surface of the elastic contact piece 43, and the section of the bulge 48 is formed into the semicircular shape. A reverse V-shape groove 49 is formed upward in the lower portion of the bulge 48.

Figure 8A:
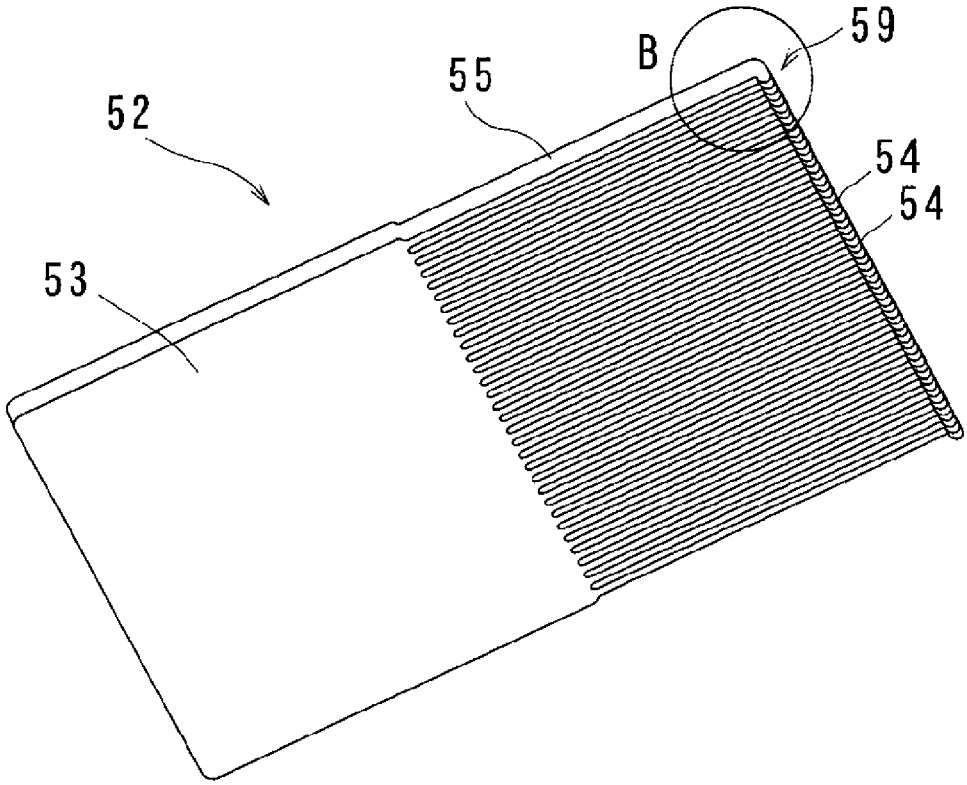
FIG. 8A is a perspective view of a brush according to a third embodiment of the present invention.
Figure 9:
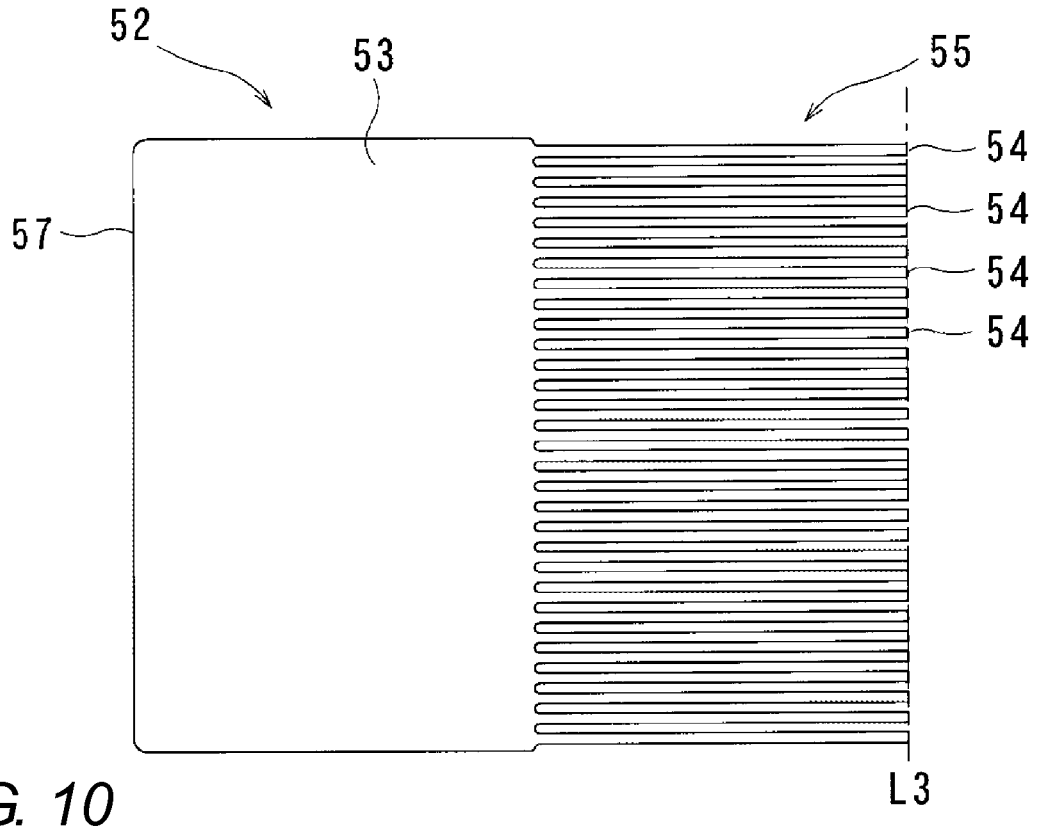
FIG. 9 is a plan view of the brush as shown in FIGS. 8A and 8B.

As illustrated in FIG. 8A, a brush 52 according to a third embodiment of the present invention includes a rectangular support 53 (see FIG. 9) and a conductive portion 55 including plurality of elastic contact pieces 54.

Figure 8B:
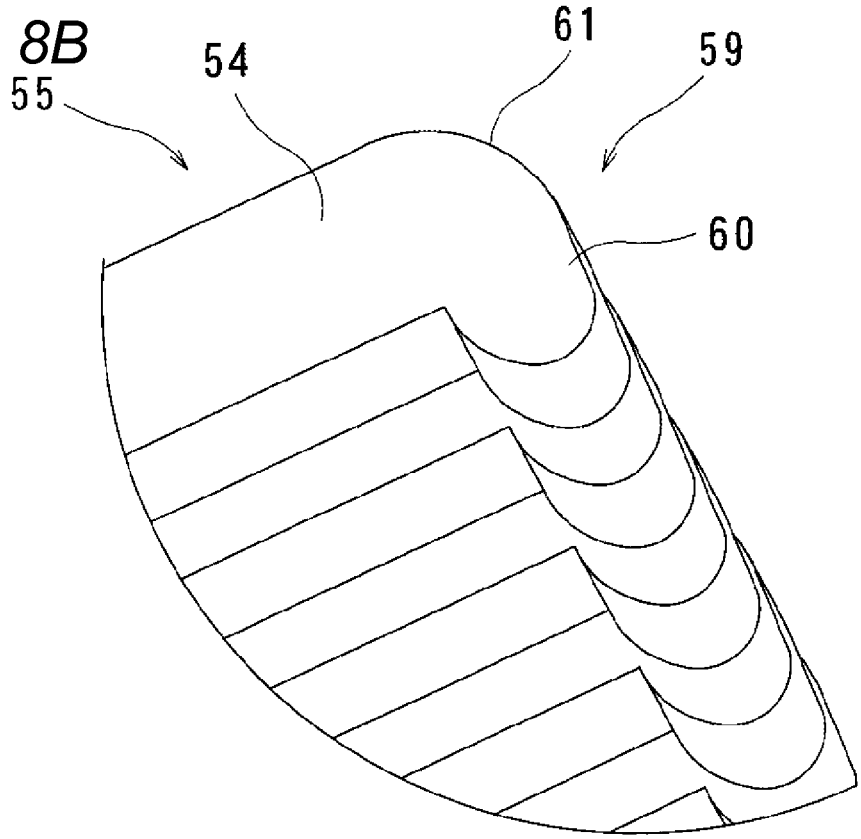
FIG. 8B is a partially enlarged perspective view of a B portion as shown in FIG. 8A.

A line L3 drawn along the leading ends of the plurality of elastic contact pieces 54 is parallel to a long side 57 of the support 53. As illustrated in FIG. 8B, a sliding portion 59 is formed in the leading end portion of each elastic contact piece 54. The sliding portion 59 includes a bulge 60 that protrudes downward from the lower surface of the elastic contact piece 54. A curved surface 61 that is continuous with the upper surface of the elastic contact piece 54 is formed in a corner portion on the upper side of the bulge 60, and the printed board 16 is in contact with the curved surface 61. A lower end of the bulge 60 has a semicircular section.

Figure 10:
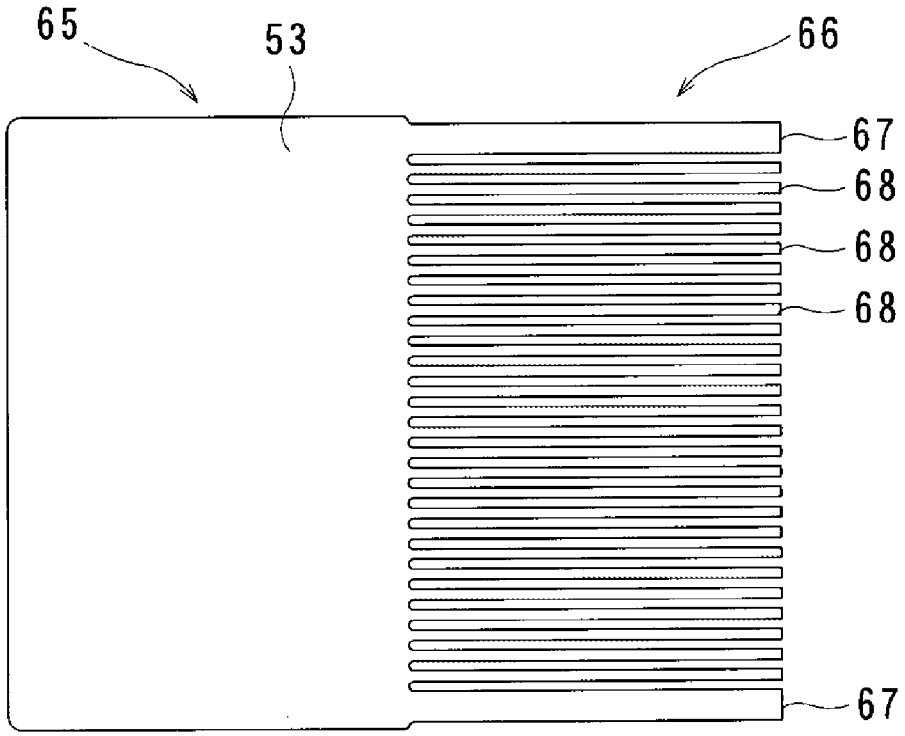
FIG. 10 is a plan view of a brush according to a fourth embodiment of the present invention.

In the embodiments, the width is homogeneously formed in all the elastic contact pieces, but is not limited thereto. For example, as in a brush 65 according to a fourth embodiment illustrated in FIG. 10, widths of elastic contact pieces 67 located on both sides of a conductive portion 66 may be made greater than those of other elastic contact pieces 68. Therefore, even if an external force is applied from a lateral side of the conductive portion 66, the high-strength, widened elastic contact piece 67 counteracts the external force, so that damage on the conductive portion 66 can be prevented. Since the other configurations are identical to those of the third embodiment, the identical component is designated by the identical numeral, and the description thereof is omitted. Therefore, even if an external force is laterally applied to the conductive portion, the high-strength, widened elastic contact pieces counteract the external force, so that damage on the conductive portion can be prevented.

Figure 11A:
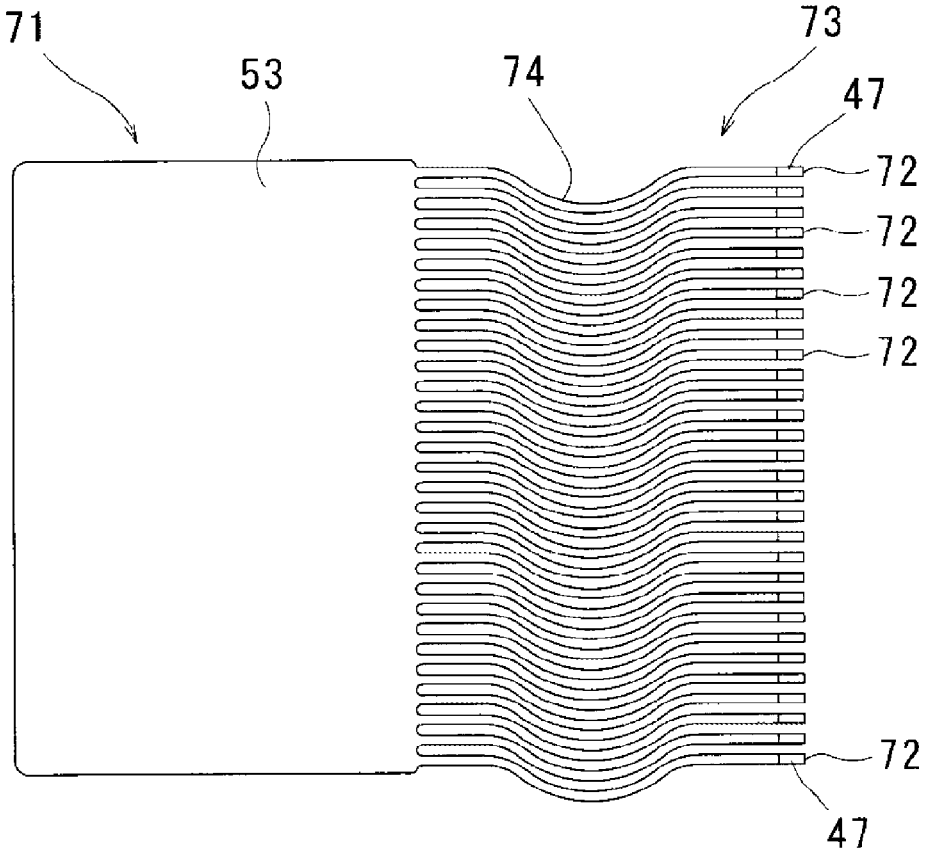
FIG. 11A is a plan view of a brush according to a fifth embodiment of the present invention.
Figure 11B:
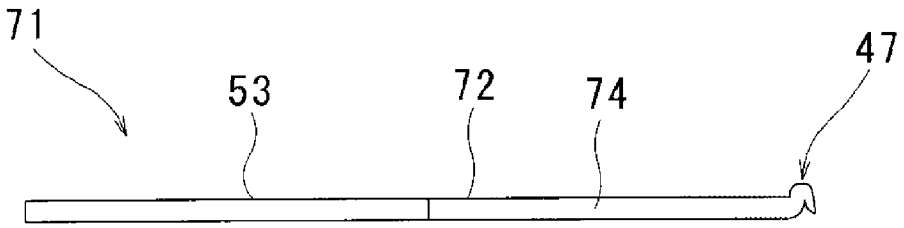
FIG. 11B is a side view of the brush as shown in FIG. 11A.
Figure 12A:
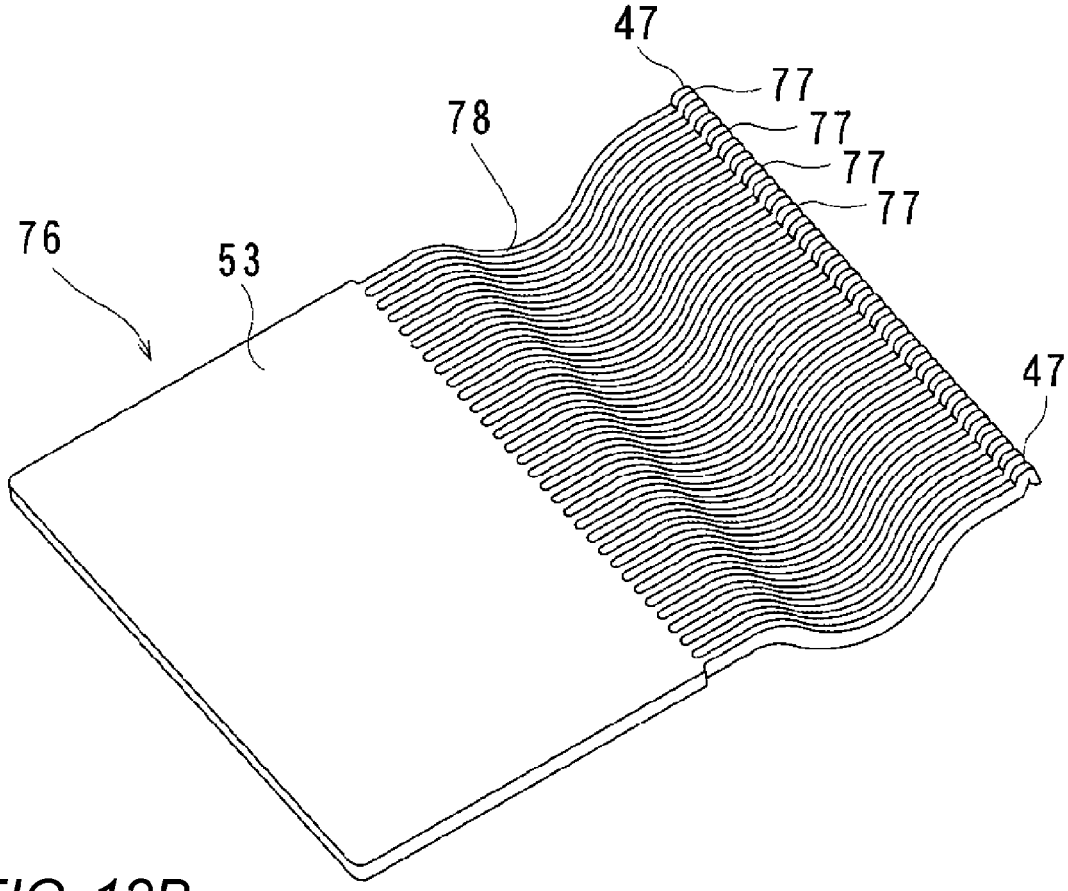
FIG. 12A is a perspective view of a brush according to a sixth embodiment of the present invention.
Figure 12B:
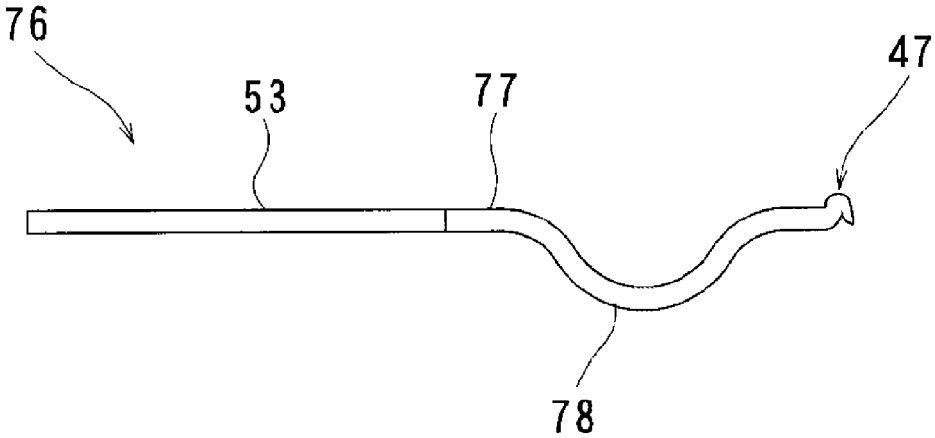
FIG. 12B is a side view of the brush as shown in FIG. 12A.

In the embodiments, the description is made on the case where the elastic contact piece is linearly formed, but is not limited thereto. For example, as illustrated in FIGS. 11A and 11B, in a brush 71 according to a fifth embodiment, a curved portion 74 that is curved in a width direction on the same surface as a conductive portion 73 is formed in a center of an elastic contact piece 72. As another example, as illustrated in FIG. 12A, a curved portion 78 that is curved downward in a thickness direction is formed in the center of an elastic contact piece 77 of a brush 76 according to a sixth embodiment (see FIG. 12(B)). The inter-support-point distance between a side edge on the side of the sliding portions 47 of the support 53 and the sliding portions 47 is lengthened by providing the curved portions 74 and 48, and a fatigue breaking is hardly occurred. Therefore, the durability of the brush 71 and 76 is enhanced. Therefore, because the inter-support-point distance is lengthened, a fatigue breaking is hardly occurred, and the durability of the conductive portion is enhanced.

Figure 13:
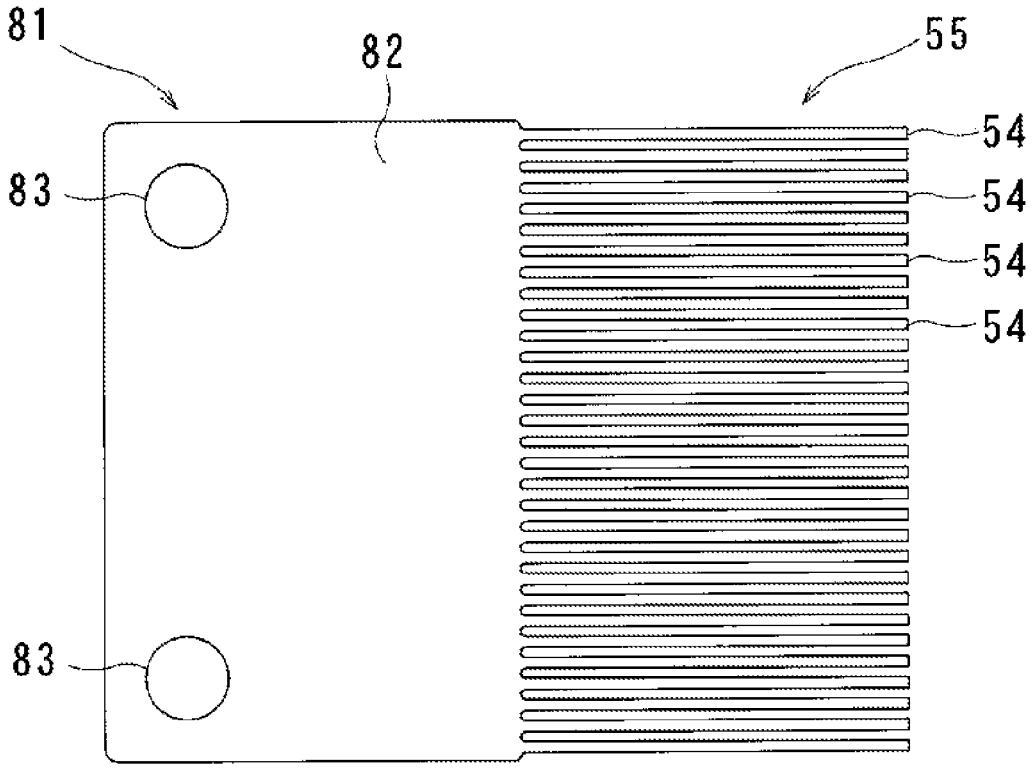
FIG. 13 is a plan view of a brush according to a seventh embodiment of the present invention.
Figure 14:
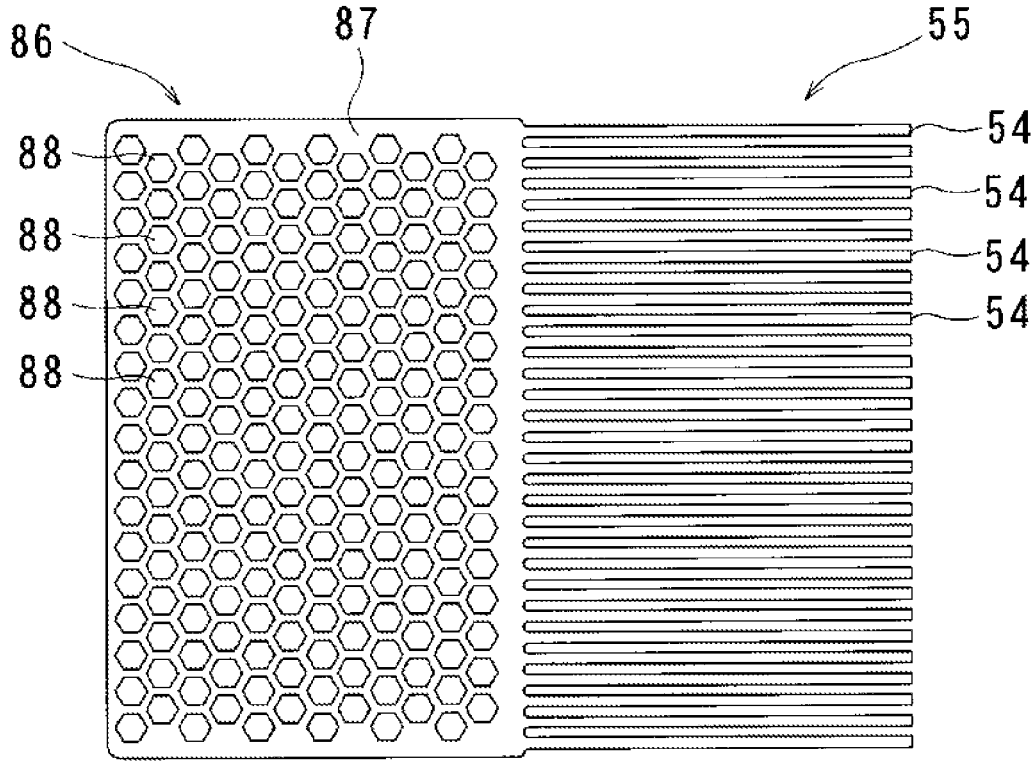
FIG. 14 is a plan view of a brush according to an eighth embodiment of the present invention.

As in a brush 81 according to a seventh embodiment illustrated in FIG. 13, a circular positioning through-hole 83 may be made at a corner of a support 82. The brush 81 is positioned using the positioning through-hole 83, which allows the high-accurate brush 81 to be produced. Similarly, as in a brush 86 according to an eighth embodiment illustrated in FIG. 14, many hexagonal through-holes 88 may be made in a support 87. Therefore, advantageously the brush 86 can be reduced in weight while the usage of the material for composing the support 87 is reduced.

The brush according to the first to eighth embodiments are described above. However, for example, such as applying the sliding portions 47 of the second embodiment to the brush 21 of the first embodiment, the support, the elastic contact pieces, the conductive portion, and the sliding portions described in each embodiment can be combined for different purposes to form the brush.

Preferably, the support may be made up of porous material. Therefore, advantageously the brush assembly can be reduced in weight while the usage of the material for forming the support is reduced.

There has thus been shown and described a connecting terminal and a connector which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An electrical brush comprising:

a support connected to a base;

a conductive portion configured to be integral with the support and having a plurality of elastic contact pieces;

wherein the conductive portion extends in parallel from a side edge of the support, and a length of each of the plurality of elastic contact pieces gradually increases from one side edge of the support to another side of the support.

2. The electrical brush according to claim 1, wherein each aspect ratio of a width to a thickness of the elastic contact pieces is from 1:4 to 1:1.5.

3. The electrical brush according to claim 1, wherein the plurality of elastic contact pieces comprises the elastic contact piece having a width different from another elastic contact piece.

4. The electrical brush according to claim 1, wherein the plurality of elastic contact pieces comprises the elastic contact piece having a thickness different from another elastic contact piece.

5. The electrical brush according to claim 1, wherein in the conductive portion of the electrical brush, a line is drawn along a leading end of the conductive portion and the line is inclined with respect to the side edge of the support.

6. The electrical brush according to claim 1, wherein a first of the elastic contact pieces is located at a first side edge of the conductive portion and a second of the elastic contact pieces is located at a second opposite edge of the conductive portion, and wherein the first and second elastic contact pieces each have a width greater than a width of the remaining elastic contact pieces which are disposed between the first and second elastic contact pieces.

7. The electrical brush according to claim 1, wherein the conductive portion is curved along a thickness direction.

8. The electrical brush according to claim 1, wherein the conductive portion is curved along a width direction.

9. The electrical brush according to claim 1, wherein the support is a parallelogram.

10. The electrical brush according to claim 1, wherein the support is made of porous material.

11. The electrical brush according to claim 1, wherein the electrical brush is produced by electroforming.

12. The electrical brush according to claim 1, further comprising a sliding portion provided at a leading end of the elastic contact pieces, wherein the sliding portion is electrically connected to an external conductor.

13. The electrical brush according to claim 12, wherein each aspect ratio of a width to a thickness of the elastic contact pieces is from 1:4 to 1:1.5.

14. The electrical brush according to claim 12, wherein the sliding portion includes a reverse U-shape bulge.

15. The electrical brush according to claim 12, wherein the sliding portion includes a reverse U-shape bulge and a protrusion that extends outward from the bulge on a straight line identical to the elastic contact piece.

16. The electrical brush according to claim 12, wherein the sliding portion includes a bulge that protrudes downward from a lower surface of the elastic contact piece and a curved surface that is continuous with an upper surface of the elastic contact piece is provided in a corner portion on an upper side of the bulge.

17. An electrical brush comprising:

a support connected to a base;

a conductive portion configured to be integral with the support and having a plurality of elastic contact pieces;

wherein the conductive portion extends in parallel from a side edge of the support; and wherein in the conductive portion of the electrical brush, a line is drawn along a leading end of the conductive portion and the line is inclined with respect to the side edge of the support.

18. An electrical brush comprising:

a support connected to a base;

a conductive portion configured to be integral with the support and having a plurality of elastic contact pieces;

wherein the conductive portion extends in parallel from a side edge of the support; and wherein a first of the elastic contact pieces is located at a first side edge of the conductive portion and a second of the elastic contact pieces is located at a second opposite edge of the conductive portion, and wherein the first and second elastic contact pieces each have a width greater than a width of the remaining elastic contact pieces which are disposed between the first and second elastic contact pieces.

* * * * *